United States Patent [19]

Hatz

[11] Patent Number: 4,766,856

[45] Date of Patent: Aug. 30, 1988

[54] STARTING HANDLE FOR INTERNAL COMBUSTION ENGINES

[75] Inventor: Ernst Hatz, Ruhstorf, Fed. Rep. of Germany

[73] Assignee: Motorenfabrik Hatz GmbH & Co. KG, Ruhstorf, Fed. Rep. of Germany

[21] Appl. No.: 89,499

[22] Filed: Aug. 25, 1987

[30] Foreign Application Priority Data

Sep. 23, 1986 [DE] Fed. Rep. of Germany ..... 3632267

[51] Int. Cl.[4] ..... F02N 1/02

[52] U.S. Cl. ..... 123/185 S; 74/6

[58] Field of Search ..... 123/185 S, 185 P, 185 C; 74/6

[56] References Cited

U.S. PATENT DOCUMENTS 1,042,303 10/1912 Williams ..... 123/185 S 1,044,315 11/1912 Webster ..... 123/185 S 1,440,311 12/1922 Munters ..... 123/185 S

*Primary Examiner*—Andrew M. Dolinar

*Attorney, Agent, or Firm*—Flynn, Thiel, Boutell & Tanis

[57] ABSTRACT

A starting handle for internal combustion engines. A hand crank and a starting shaft are connected to an appropriate element of the engine to be started. A driving mechanism is provided between the hand crank and the starting shaft, so that when the hand crank is turned in the starting direction, the hand crank drives the starting shaft and thereby the engine element. The driving mechanism is released in the event of kickback of the starting shaft and movement thereof in the direction opposite to the direction of starting. A weighted element is provided independent of the engine and is mounted coaxially with respect to the starting shaft. The weighted element is held by gravity in a vertical position and, in the event of kickback, is restrained from movement from the vertical to cause the driving mechanism between the hand crank and the starting shaft to be released.

4 Claims, 2 Drawing Sheets

STARTING HANDLE FOR INTERNAL COMBUSTION ENGINES

FIELD OF THE INVENTION

The invention relates to a starting handle for internal combustion engines, having a hand crank and a starting shaft which can be connected to a suitable element of the engine to be started, a driving mechanism being provided between the hand crank and the starting shaft. When the hand crank is turned in the starting direction, the driving mechanism drives the starting shaft and the engine element, and is released in the event of kickback of the starting shaft and movement thereof in the direction opposite to the direction of starting.

This invention is a further development of U.S. Pat. No. 4 556 021.

SUMMARY OF THE INVENTION

It is an object of the invention to provide a starting handle which, on the one hand, has a minimum of structural elements, thus making manufacture inexpensive, and which, on the other hand, protects the operator from injury in the event of kickback of the said engine element. This object is achieved by the invention in that a weighted element is provided which is independent of the engine and is mounted coaxially with respect to the starting shaft, which element is held by gravity in its vertical position such that it is restrained from movement and, in the event of kickback, causes the driving connection between the hand crank and the starting shaft to be released.

A particularly space-saving embodiment of the invention is obtained if an uncoupler, which is mounted coaxially with respect to the starting shaft, and a freewheel clutch having two bearing rings and clamping elements interposed therebetween are provided, the first bearing ring of the freewheel clutch being connected to the uncoupler, and the second bearing ring to the weighted element in such a way that, when the hand crank and therewith the starting shaft and the said engine element are moved in the starting direction, the first bearing ring of the freewheel clutch freewheels in the same direction with the uncoupler, whereas the second bearing ring is held in a fixed position by the weighted element, and such that, in the event of kickback of the starting shaft in the direction opposite to the starting direction, the freewheel clutch is locked and the uncoupler is detained by the non-moving weighted element, whereupon the detained uncoupler releases the driving connection between the hand crank and the starting shaft. It is advantageous for the driving mechanism to be in the form of a pivoted lever which is held resiliently against a stop, one end of the lever being mounted in a housing of the hand crank and the other end cooperating with a driving face on the starting shaft. The uncoupler is provided with a control projection which, when the freewheel clutch is locked during kickback, moves the end of the pivoted lever out of engagement with the driving face of the starting shaft.

According to a further feature of the invention, the second bearing ring of the freewheel clutch is secured in a bearing cover surrounding the starting shaft, to which bearing cover the weighted element, which is in the form of a ball or the like, is secured by way of a connecting arm.

BRIEF DESCRIPTION OF THE DRAWINGS

One embodiment of the invention is further described below with reference to the accompanying drawings, in which.

DETAILED DESCRIPTION

Figure 1:
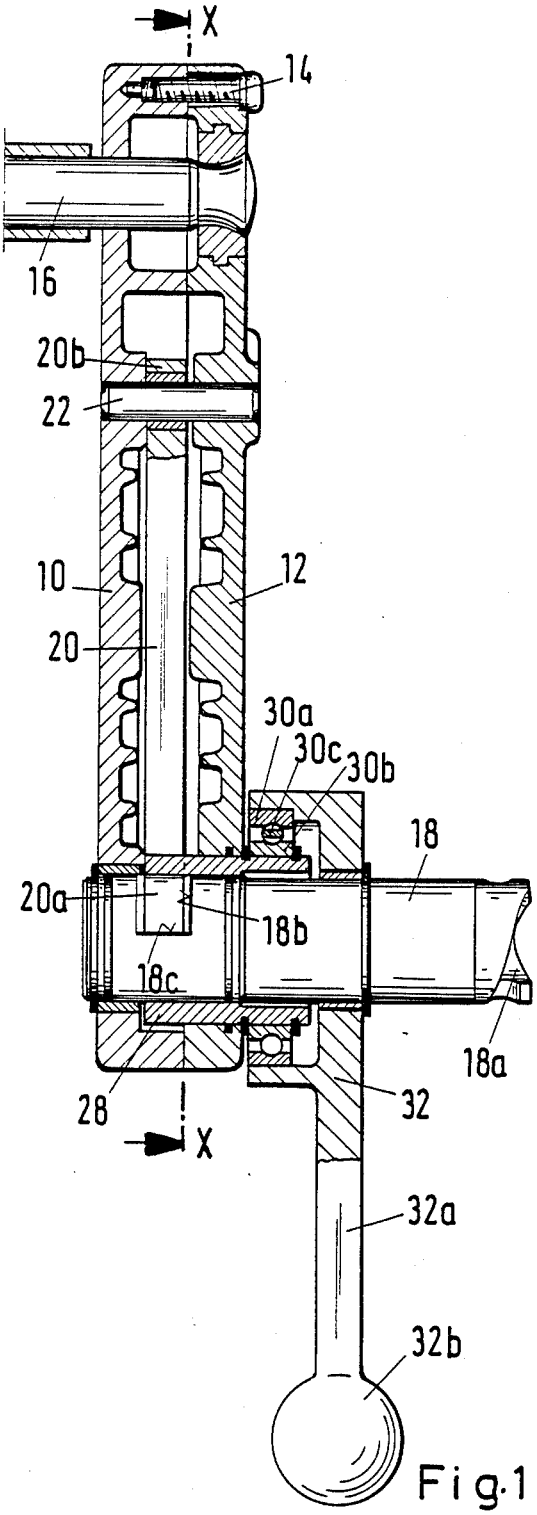
FIG. 1 is a longitudinal section through the starting handle.

As shown in FIG. 1, a starting handle comprises a flat, elongate housing made of two housing halves 10, 12, which are connected to one another by means of a plurality of screws 14. A hand crank 16 is rotatably mounted in one end region of the housing, whereas a starting shaft 18 is freely rotatably mounted on the other end region of the housing. The end of the starting shaft 18 projecting out of the housing 10, 12 is provided on its end face with dogs **18*a*** which, following insertion into an appropriate element of the engine to be started, for example into an axial bore at the end of the crank shaft (not shown) of the engine, move in a known way into coupling engagement with a cross pin of this engine element.

A transverse slot **18*b* having a driving face 18*c* is provided in the region of the starting shaft inside the housing 10, 12 with one end 20*a* of a pivoted lever 20 resting against said driving face in the starting position. This pivoted lever is accommodated in the hollow space between the housing halves 10, 12, its end 20*b* being pivotably mounted on a bearing pin 22. A spring 24, which is inserted between the parts 12 and 20, biases the pivoted lever 20 in a counter-clockwise manner against a stop 26, so that the continued engagement of the parts 18 and 20** is ensured.

A sleeve 28 acting as an uncoupler, is freely rotatably mounted in the housing part 12 and surrounds the starting shaft 18 and its transverse slot **18*b*. A cut-out 28*a* in the end face of the sleeve 28 allows the end 20*a* of the pivoted lever 20 to pass through, which lever, in doing so, rests against one boundary area 28*b* and partially against the other boundary area 28*c* of the cut-out 28*a* in the sleeve 28**.

A known freewheel device or overrunning clutch is provided which has two bearing rings **30*a*, 30*b* and clamping elements 30*c* disposed therebetween. The bearing ring 30*a* is secured, for example shrunk onto, the region of the sleeve 28 projecting from the housing part 12, whereas the other bearing ring 30*b* is tightly fitted in a metallic bearing cover 32 which surrounds the starting shaft 18 freely. The end of an arm 32*a* projecting from the edge of the cover 32 is provided with a ball 32*b*. The weight of the parts 32*a* and 32*b* is such that the bearing cover 32 and bearing ring 30*a* remain in the position shown under the influence of gravity. The parts 32*a* and 32*b*** thus represent a weighted element.

Figure 2:
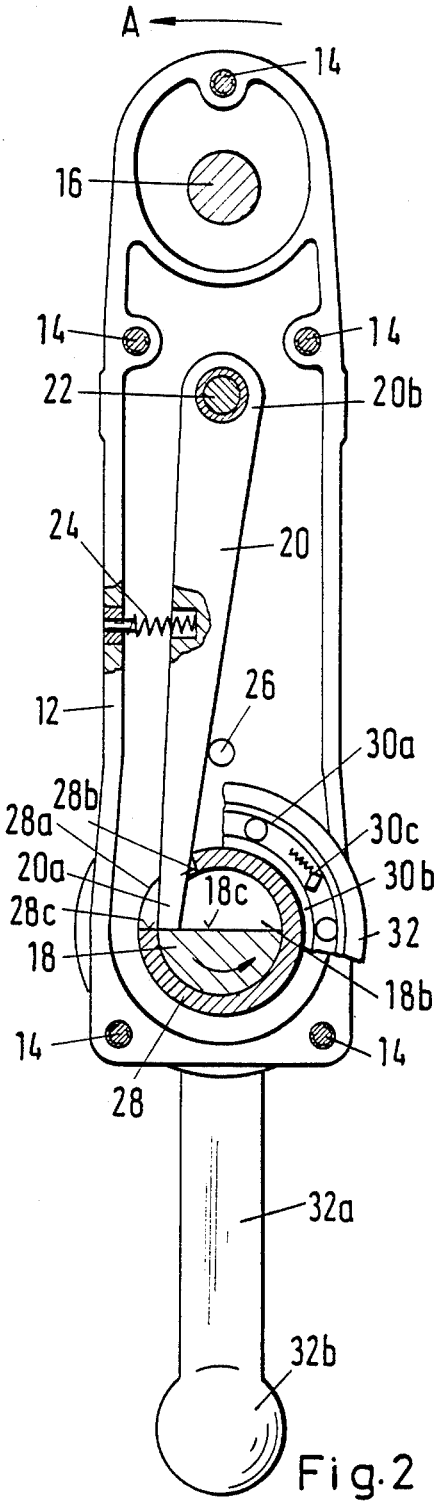
FIG. 2 is a section through the starting elements along the line II—II in FIG. 1.

The starting elements in FIGS. 1 and 2 are in the positions necessary for starting the internal combustion engine. When the operator inserts the starting handle into the element of the engine to be started and turns the handle in the direction of turning A (FIG. 2) about the axis of the starting pin 18 by means of the crank 16, the said engine element is driven in the same direction until the engine starts. The sleeve 28 and the bearing ring **30*b* turn freely along with it, whereas the bearing ring 30*a* is held immovably owing to the inertia of the weighted element 32***a*, 32*b*. The clamping elements of the overrunning clutch thus take up a non-clamping position, so that free relative rotation takes place in the freewheel clutch.

As soon as the engine and its starting element have reached a particular rotational speed, the starting shaft 18 itself rotates more rapidly than the rest of the starting handle, so that the driving face 18*c*, which is moving faster in the direction of starting, contacts the pivoted lever 20 on its longitudinal side, causes it to swing in the clockwise direction relative to the housing 10, 12 and hence releases the arrangement of the starting shaft 18 with the other elements of the device. The starting handle can now be stopped by the operator and together with the starting shaft 18 withdrawn axially from the running engine.

Figure 3:
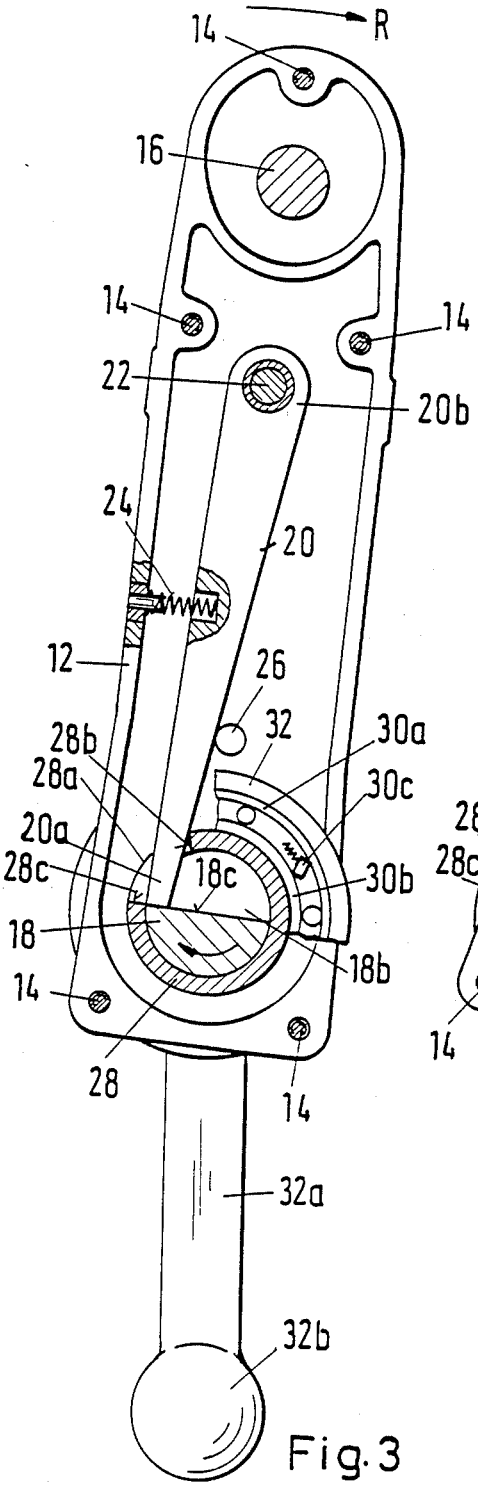
FIGS. 3 and 4 show the starting elements in two different operating positions.
Figure 4:
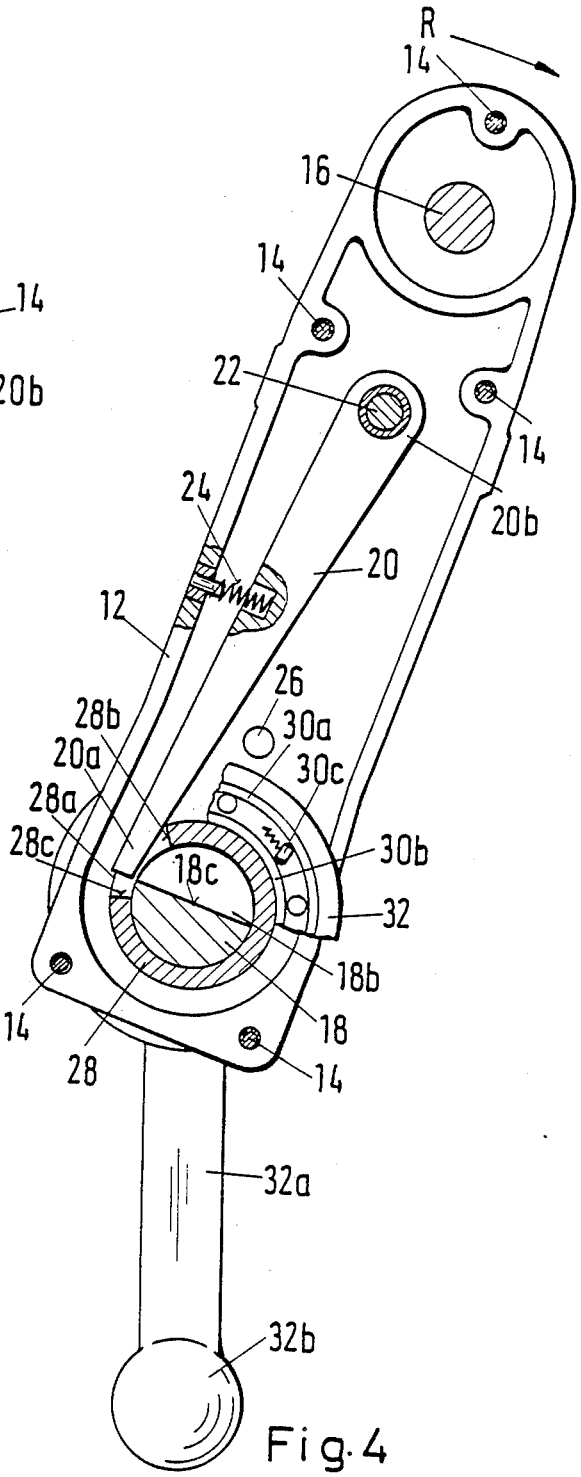

If, however, kickback occurs during the process of starting the engine, that is, if the engine element moves in the direction R shown in FIG. 3 (for example if the engine misfires), the starting shaft 18 is also turned in the direction R. As the pivoted lever 20 is engaged with the starting shaft 18, the entire starting handle is also driven in the direction R. The uncoupling sleeve 28 with the bearing ring 30*b* is also driven through a slight angle in the same direction R, until the clamping elements 30*c* are moved into the locking position by this reverse motion of the bearing ring 30*b*, so that, given the immobility of the bearing ring 30*a*, which is achieved as a result of the inertia of the weighted element (32*a*, 32*b*), a freewheel lock occurs (FIG. 3). During a further slight angular rotation of the elements in the direction R, the end 20*a* of the pivoted lever 20, which is still being moved with the starting handle, is taken out of engagement with the starting shaft 18, 18*c* by the face 28*b* of the uncoupling sleeve 28, which is now stationary (FIG. 4). The starting crank is now free of the starting shaft 18, which continues to rotate with the engine shaft, and can thus be stopped safely by the operator shortly after the occurrence of kickback (after approximately 10° of the kickback movement).

As soon as the starting process is continued once the engagement has been released (FIG. 4), the operator turns the hand crank 16 and the starting handle from the position in FIG. 4 back in the direction A. The end 20*a* of the pivoted lever 20 initially engages with the surface 28*c* of the sleeve 28, as a result of which the sleeve rotates together with the bearing ring 30*b* in the same direction A. The lock of the freewheel clutch is released, as the bearing ring 30*a* is held in a stationary position by the weighted element 32*a*, 32*b*. After approximately one revolution of the starting handle in the direction A, the end 20*a* of the pivoted lever 20 falls into the recess 18*b* again, so that the engagement between the parts 20*a* and 18*c*, which is necessary for starting and which is shown in FIG. 2, is established once again.

It should be pointed out that the weight of the elements 32*a*, 32*b*, which are under the influence of gravity and which cause the uncoupling to take place, is such that the moment of inertia required to stop the uncoupler 28 and to release the engagement between the parts 20*a* and 18*c*, is easily achieved.

It should also be pointed out that, in place of the arrangement of the elements 32*a* and 32*b* as shown, the carrier of the freewheel bearing ring 30*a* could also be in the form of a protective disc which surrounds the starting shaft and on which a weight, which is subjected to the force of gravity, is eccentrically mounted.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a starting handle for internal combustion engines, comprising a hand crank and a starting shaft which can be connected to an appropriate element of the engine to be started, a driving mechanism being provided between the hand crank and the starting shaft, so that when the hand crank is turned in the starting direction, the hand crank drives the starting shaft and thereby the said engine element, the driving mechanism being released in the event of kickback of the starting shaft and movement thereof in the direction opposite to the direction of starting, the improvement comprising wherein a weighted element is provided which is independent of the engine, and which is mounted coaxially with respect to the starting shaft, the weighted element being held by gravity in a vertical position and, in the event of kickback, being thereby restrained from movement from the vertical to cause the driving mechanism between the hand crank and the starting shaft to be released, wherein there is provided an uncoupler mounted coaxially with respect to the starting shaft, and a freewheel clutch having first and second bearing rings and clamping elements interposed therebetween, a first bearing ring of the freewheel clutch being connected to the uncoupler and the second bearing ring to the weighted element in such a way that, when the hand crank and therewith the starting shaft and the said engine element are moved in the starting direction, the first bearing ring of the freewheel clutch freewheels with the uncoupler in the same direction, whereas the second bearing ring is held in a fixed position by the weighted element, and wherein, in the event of kickback of the starting shaft and in the opposite direction to the starting direction, the freewheel clutch is locked and the uncoupler is detained by the gravity restrained weighted element, whereupon the detained uncoupler releases the driving connection between the hand crank and the starting shaft.

2. The starting handle as claimed in Claim 1, wherein the driving mechanism comprises a pivoted lever which is held resiliently against a stop, one end of the lever being mounted in a housing of the hand crank and the other end cooperating with a driving face on the starting shaft.

3. The starting handle as claimed in Claim 2, wherein the uncoupler has a control projection which, when the freewheel clutch is locked during kickback, moves the end of the pivoted lever out of engagement with the driving face of the starting shaft.

4. The starting handle as claimed in Claim 1, wherein the second bearing ring of the freewheel clutch is secured in a bearing plate, to which the weighted element, which is in the form of a ball or the like, is secured by way of a long connecting arm.

* * * * *